US006628206B1

(12) United States Patent
Soulier

(10) Patent No.: US 6,628,206 B1
(45) Date of Patent: Sep. 30, 2003

(54) METHOD AND SYSTEM FOR THE TRANSMISSION OF INFORMATIONS BY ELECTROMAGNETIC WAVE

(75) Inventor: Louis Soulier, Sannois (FR)

(73) Assignee: Geoservices S.A., Le Blanc-Mesnil (FR)

( * ) Notice: Subject to any disclaimer, the term of this patent is extended or adjusted under 35 U.S.C. 154(b) by 0 days.

(21) Appl. No.: 09/407,059

(22) Filed: Sep. 28, 1999

(30) Foreign Application Priority Data

Oct. 23, 1998 (FR) ..... 98 13304

(51) Int. Cl.[7] ..... G01V 1/22

(52) U.S. Cl. ..... 340/854.4; 340/854.5; 340/855.1

(58) Field of Search ..... 340/854.3, 854.4, 340/854.5, 854.6, 855.1, 855.7

(56) References Cited

U.S. PATENT DOCUMENTS 3,967,201 A * 6/1976 Rorden ..... 340/850
4,001,774 A * 1/1977 Dawson et al. ..... 174/47
4,684,946 A 8/1987 Issenmann ..... 340/854.6
4,793,409 A * 12/1988 Bridges et al. ..... 138/146
5,394,141 A * 2/1995 Soulier ..... 175/40
5,576,703 A * 11/1996 MacLeod et al. ..... 175/40

FOREIGN PATENT DOCUMENTS

EP 0 816 632 1/1998
WO WO 98/06924 2/1998

* cited by examiner

*Primary Examiner*—Michael Horabik
*Assistant Examiner*—Hung Dang
(74) *Attorney, Agent, or Firm*—Oblon, Spivak, McClelland, Maier & Neustadt, P.C.

(57) ABSTRACT

A method and a system for the transmission of information from a well (1; 20) drilled through geological formation layers (3) at least partly cased by metal tubes (4; 23; 24; 31). The method includes the placing in said well of an information transceiver (E) operating by electromagnetic waves created by the injection of an electric signal by a dipole (P1–P2) conductively connected to the metal tubes used for guiding the transmitted waves. In the method, identification takes place of the attenuation of the transmission by certain formation layers (3*a*, 3*b*; 25; 30) having a low resistivity and then there is an at least partial electrical insulation of the metal tubes located opposite the low resistivity layers.

16 Claims, 5 Drawing Sheets

METHOD AND SYSTEM FOR THE TRANSMISSION OF INFORMATIONS BY ELECTROMAGNETIC WAVE

Figure 1:
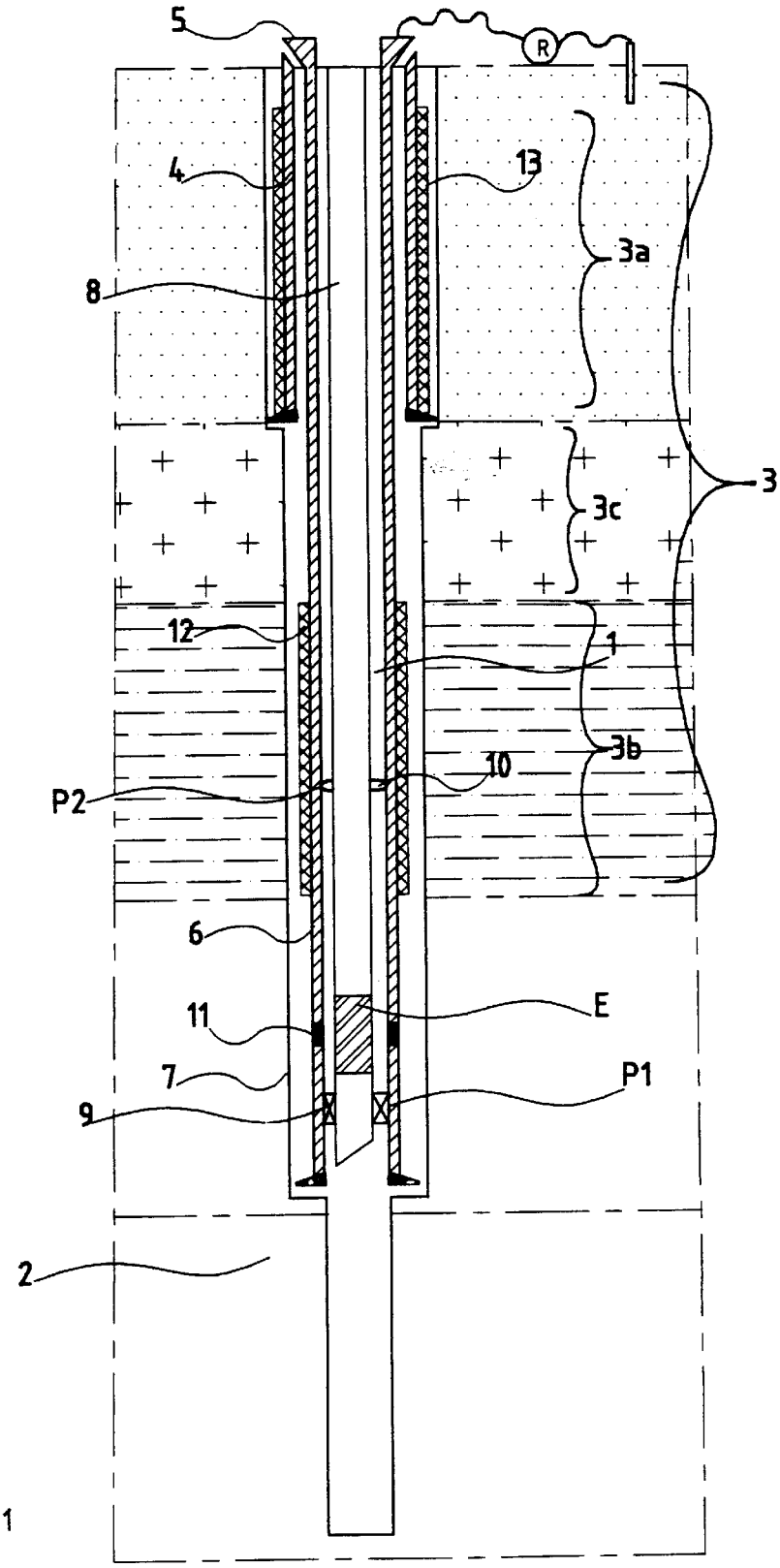

The invention is in the field of information transmission from a well drilled in the ground up to the surface. More particularly, the invention relates to a optimized method for the transmission of informations between the bottom of a drilled well and the surface, the well either having already been drilled and is in production, or is in the process of being drilled.

Various systems are known for the transmission of informations between the bottom of a well and the surface, e.g. by mud pulses in a fluid circulating in the well. However, it is known that this type of transmission suffers from the disadvantage of not operating correctly or not operating at all in a compressible fluid, such as gas or liquids charged with gas, or when there is an obstruction in the circulation channel disturbing the flow, e.g. an underground motor, valve or nozzle. Moreover, this system is obviously inoperative during production and manipulation of the drill string.

The system of transmission by electromagnetic waves guided by metal tubings placed in the well is also known. This transmission system is more particularly described in FR 2681461 of the present applicant, cited here for reference purposes. The performance characteristics of the electromagnetic transmission (EM) are dependent on the mean resistivity of the geological formations surrounding the well. If the resistivity of certain layers is inadequate, as is the case with certain sedimentary, tertiary, peri-continental rocks like those of the North Sea or the Gulf of Mexico, the attenuation can become excessive along the well, which makes it impossible to use such a device in most offshore wells unless it is possible to accept a drastic reduction in the transmitted information flow.

Thus, the present invention relates to a method for the transmission of informations from a well drilled through geological formation layers, at least partly cased by metal tubes, the method comprising the placing in said well of an information transceiver operating by guided electromagnetic waves created by the injection of an electric signal by a dipole conductively connected to the metal tubes used for guiding the transmitted waves. According to the method, identification takes place of the attenuation of the transmission by certain formation layers having a low resistivity and there is an at least partial electrical insulation of the metal tubes positioned opposite said low resistivity layers.

With the aid of a mathematical model it is possible to determine the minimum length to be insulated, bearing in mind the minimum characteristics of said electromagnetic transmission, more particularly the transmission distance and/or the information flow rate.

Insulation can be obtained by the installation of tubes previously coated with an insulating material layer.

In a variant, insulation can be obtained by the putting into place of an insulating material of the cement type opposite said formations in the annular space between the tubes and the formations.

The transceiver can be positioned close to the lower end of a production tubing in order to transmit sea bed or bottom measurements or instructions to sea bed or bottom equipment.

Said transceiver can also be positioned close to the lower end of a drill string in order to transmit bed or drilling parameters, or tracking or location measurements.

The invention also relates to a system for the transmission of informations from a well drilled in geological formation layers, at least partly cased by metal tubes, the system comprising in said well an information transceiver operating by means of guided electromagnetic waves created by the injection of an electric signal by a dipole conductively connected to the metal tubes used for guiding the transmitted waves. In the system, at least some of the metal tubes positioned opposite the low resistivity layers have means for electrical insulation with said formation., The insulated tubes can be coated with an insulating material layer. The insulating layer may not cover the entire length of the tube.

In the system, the insulating means can comprise an insulating material filling the annular space between the tubes and the conductive formation, the material being the result of the hardening of a liquid composition.

The transceiver can be incorporated into the end of a production tubing.

The transceiver can also be incorporated into the end of a drill string.

The system according to the invention can be applied to an ocean drilling installation with a subsea wellhead.

In this application, a kill-line can be externally electrically insulated from the sea bed to the surface.

The invention is described in greater detail hereinafter relative to non-limitative embodiments and with reference to the attached drawings, wherein show:

FIG. 1 Diagrammatically an implementation of the invention for a well which is in production.

Figure 2:
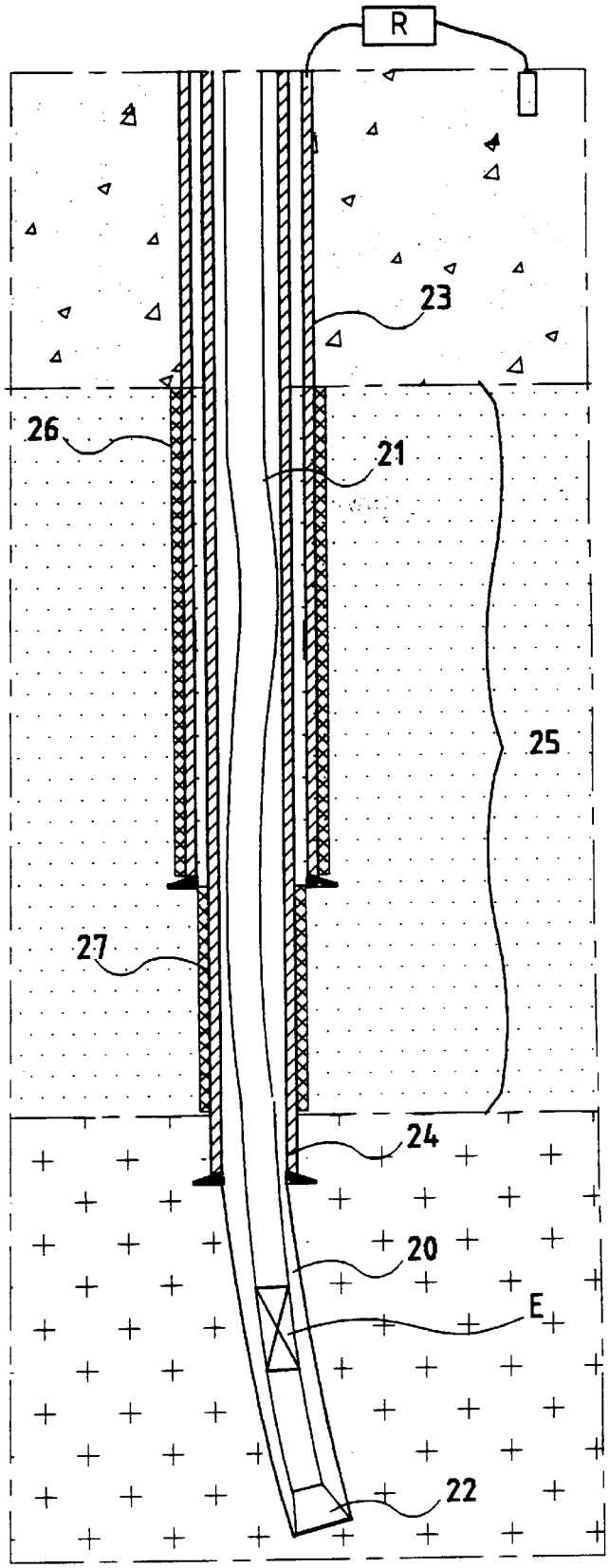

FIG. 2 An embodiment of the invention during the drilling of a well.

Figure 3:
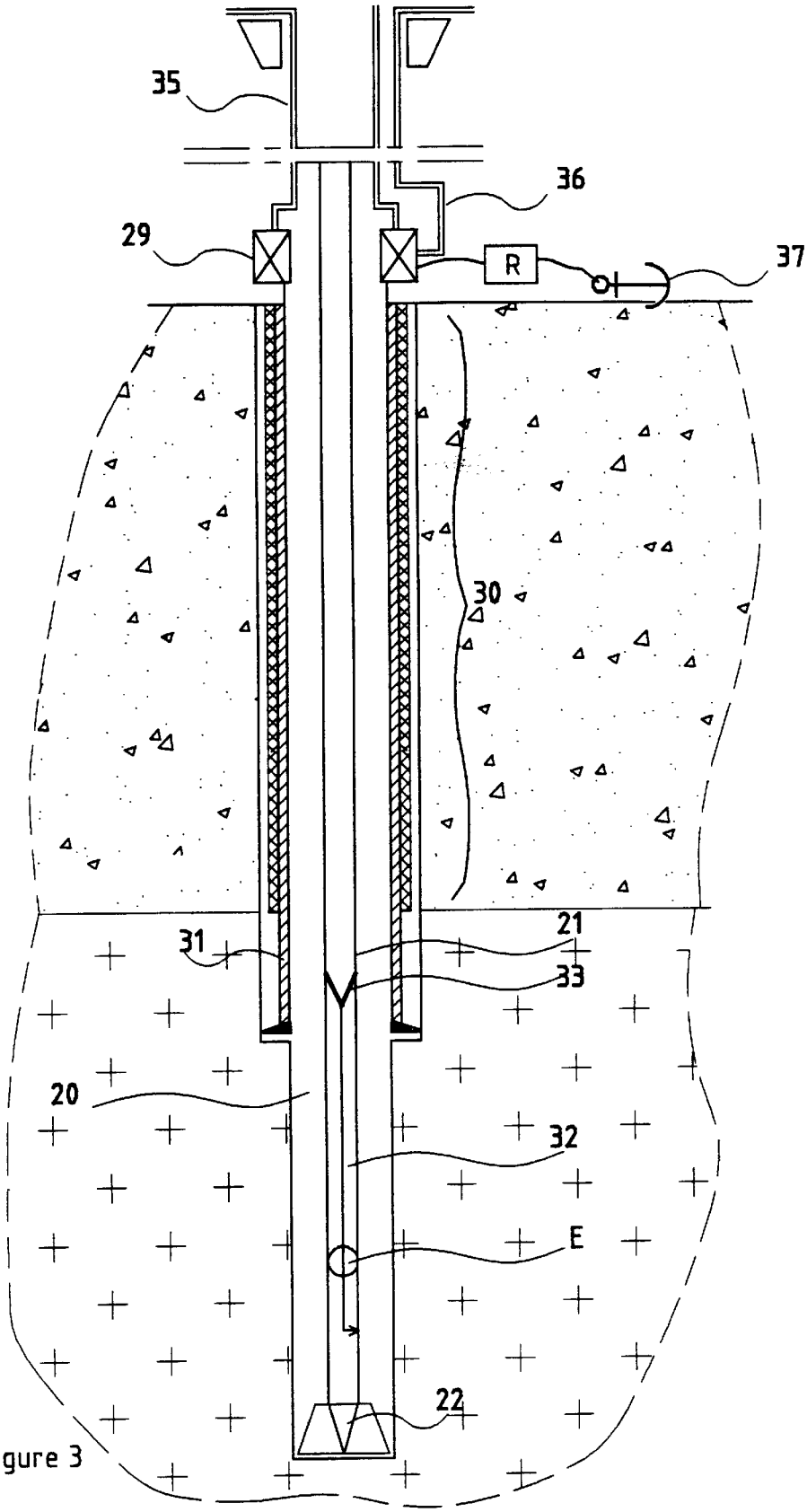

FIG. 3 A drilling variant.

Figure 4:
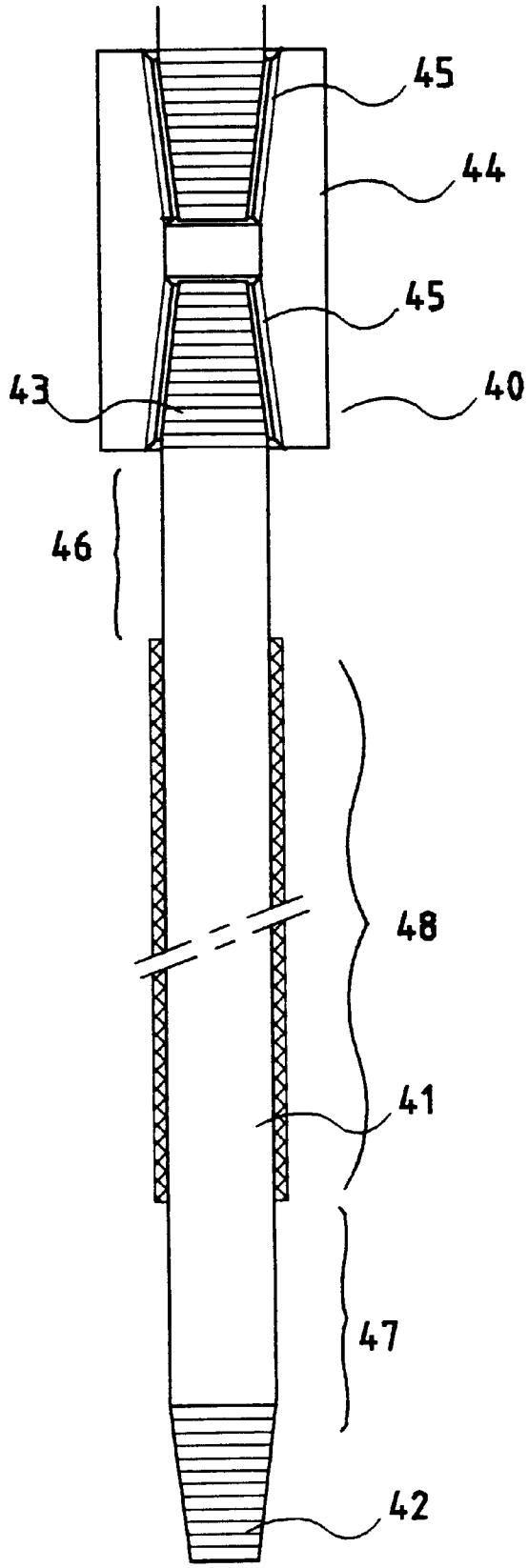

FIG. 4 In section the example of a casing tube element externally coated with an electrical insulant.

Figure 5:
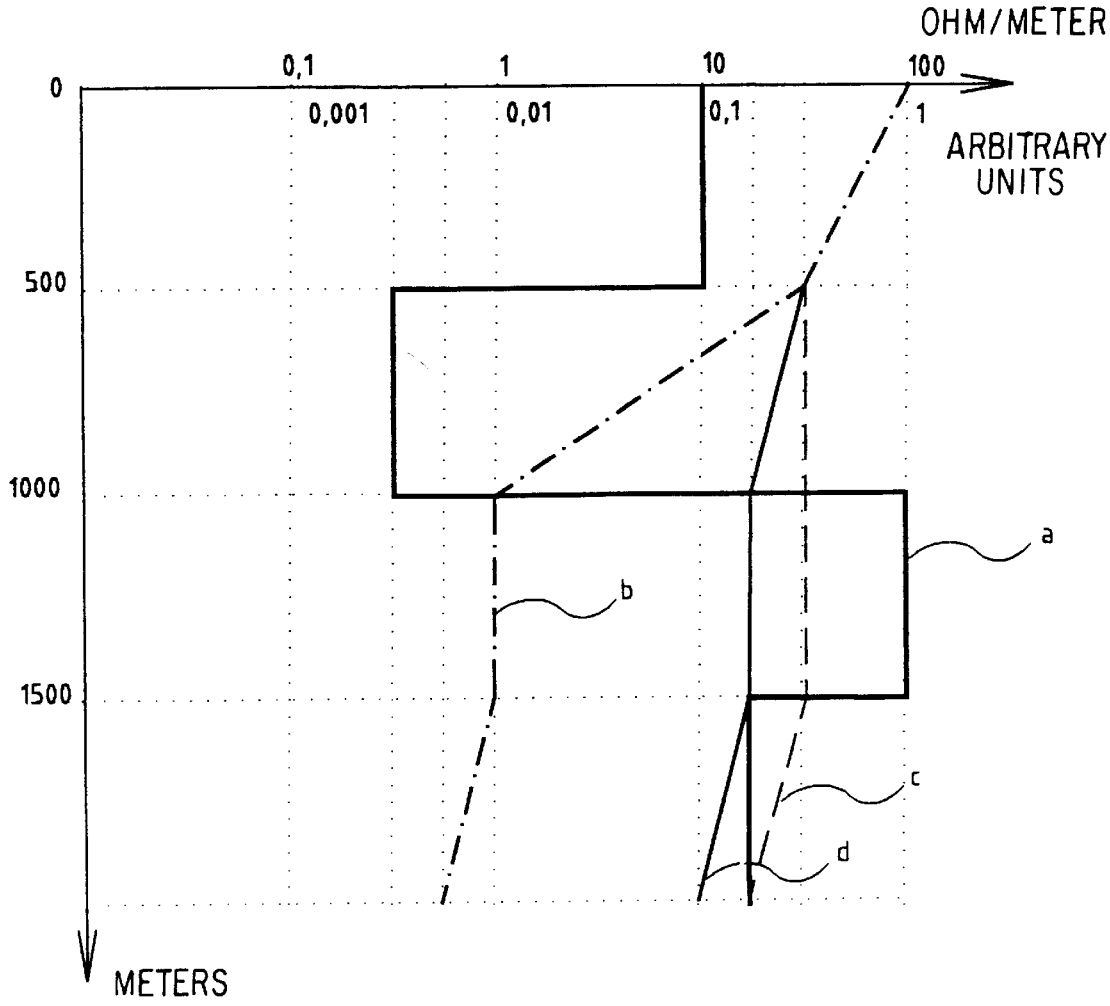

FIG. 5 An example of the attenuation of the signal as a function of the drilling depth and the resistivity of the traversed formations.

FIG. 1 shows a well 1 already drilled down to a geological area 2, which generally has at least one layer forming a reservoir containing effluents to be produced. In the present case, the rock layers 3, located between layer 2 and the surface, attenuate the electromagnetic waves in such a way that it is impossible to effectively use the known electromagnetic wave transmission method. As a result of logging measurements, it was possible to establish that layers 3*a* and 3*b* have resistivities well below 20 Ω.m, e.g. a few Ω.m or even below 1 Ω.m. However, area 3*c* has a resistivity above 20 Ω.m, e.g. a salt layer, which is frequently encountered when drilling. Prior to drilling a well in which the method according to the invention is to be used, it is virtually always possible to obtain a resistivity log (recording as a function of depth), e.g. by extrapolating it from seismic profiles and logs of wells drilled in said area. Curve a in FIG. 5 is an example of such a curve. On the basis of a mathematical model of the propagation of electromagnetic waves along drill rods and casings of the well in question, this log enables us to calculate the attenuation of the electromagnetic signal between the transmission point E and the reception point R. The model used will e.g. be of the type described in the article SPE Drilling Engineering, June 1987, P. Degauque and R. Grudzinski. On the basis of this calculation determination takes place, prior to drilling, of the signal level which will be received or which should be received at the surface all along the descent of the transmitter. Curve b in FIG. 5 shows an example of this signal. The signal obtained during the drilling of the well will be recorded and compared in real time with the signal calculated on the basis of the forecasting log, thus making it possible to adjust the real position of the different geological layers and the real value of their resistivity. This is only possible through knowing the current transmitted by the transmitter, which is the case for the transmitter in question.

Knowing the maximum acceptable attenuation between transmitter E and receiver R for the desired information flow rate, it is possible to accurately determine the length of the casing to be covered, choosing firstly to insulate the low resistivity areas such as those between 500 and 1000 m in FIG. 5.

In FIG. 5, on the basis of the previously defined curves a and b, two other curves c and d are shown:

Curve c represents the signal obtained along the well in the case where there is a perfect electrical insulation of the exterior of the casing with respect to the surrounding formations between 500 and 1000 m. The attenuation reduction is approximately 35 dB, in accordance with the considered propagation parameters (carrier frequency 5 Hz in this case).

Curve d represents the signal obtained along the well in the case where only the body of the casings is insulated. This amounts to considering, for the available propagation model, a perfect insulation of the casing over 27 m and then an electrical conduction over 0.5 m. The total attenuation gain is then approximately 24 dB.

By means of this method and knowing the information flow rate to be obtained, it will be technically possible to determine and install the casing necessary for the desired transmission.

It should be noted that the method would not be changed if the electromagnetic signal were relayed by a transceiver positioned between the well bottom transmitter and the surface and particularly if the latter was located in the uncased area of the well.

It is pointed out that the information flow rate Df is calculated by the following formula:

$$Df=\Delta F \log_2(1+S/B)$$

with ΔF the useful modulation band width, S the signal and B the noise in the useful band.

Transmission takes place by transmitter E in FIGS. 1, 2 and 3. Transmitter E modulates a very low frequency wave, said frequency being chosen relatively low so as to enable propagation to take place. Preferably, the transmission means use frequency waves between 1 and 10 Hz. This carrier frequency wave is, in an embodiment, modulated as a function of the informations to be transmitted, by phase jump 0-π at a timing compatible with the carrier frequency. Other modulation types can be used without passing outside the scope of the present invention. The modulation rate is approximately 1 bit/second, but can be adapted as a function of transmission needs. In the case of instructions and commands for sea bed devices such as valves, it would be possible to use length codes adapted to the maximum accepted error probability. As a function of the particular case, coding may or may not be associated with detector codes and error correctors, such as cyclic redundancy codes.

The wave transmitted by the transmitter E is received at the surface by the receiver R, whereof one of the poles is connected to the wellhead and the other pole is placed in the ground at an adequate distance from the wellhead. In practice, E and R can in turn constitute a transmitter and receiver. The electronic transmission/reception means E can advantageously be arranged in accordance with the technology described in U.S. Pat. No. 5,394,141, cited here for reference purposes. Reference can also be made to the publication SPE/IADC 25686 presented by Lous Soulier and Michel Lemaitre to the SPE/IADC Drilling Conference in Amsterdam on Feb. 23–25, 1993.

In FIG. 1, a first tubing 4 (surface tubing) is placed in the well 1 and is generally cemented over its entire height in the surface formation 3*a*. A wellhead 5 installed on the surface tubing makes it possible to receive the upper end of other, technical or production tubings, as well as the safety valves. A second casing 6 is lowered into the drilled hole or well 7 from the surface tubing set or shoe 4 and down to the cover of the reservoir 2. The annular space between the well 7 and the casing 6 is generally filled with cement, at least up to the set of the preceding tubing, in the present case the set of the surface tubing 4. A production tubing 8, whose function is to raise the effluent to the surface, passes through a packer 9, which ensures the sealing of the reservoir area with respect to the annular space around the tubing 8. In the lower part of the tubing is installed a transceiver E. For transmission EM, the poles P1 and P2 of the dipole can be constituted by the contact formed by the packer 9 with the metal casing 6 and the contact provided by a blade centralizer 10 placed higher up in the tubing 8. In certain cases, the upper contact is directly formed by the contact of the tubing with the casing 6, taking account of the generally small annular space and the geometry of the well. An insulating coupling 11 opposite the transmitter can be used in the casing 6 for separating the lower contact P1 from the upper contact P2. However, said insulating coupling is unnecessary when using the so-called long dipole construction for the transmission or reception antenna. In this case, it is necessary to ensure that the pole P2 is sufficiently far away from the pole PI and is unable to have any contact there between casing 6 and tubings 8 over the length between the poles.

According to the invention, the performance characteristics of the transmitter E are improved by electrically insulating the casing 6 from the highly conductive geological formation 3*b*. This insulation is represented by the field 12. It is important to note that the area 3*c*, which is known to have an adequate resistivity so as not to give rise to a prejudicial attenuation, e.g. above approximately 20 Ω.m, does not have to be electrically insulated. In this example, surface areas 3*a* are not favourable for a good transmission. As a function of the information flow needs, the surface tubing 4 will also be insulated from the formation 3*a* (represented by the field 13).

In the present invention, the insulation of the tubings with respect to the rock areas can be obtained by covering the outer wall of the tubes with an insulating or almost insulating layer. Thus, according to the invention the electrical insulation required is of a relative nature, because rock areas with a resistivity above 20 Ω.m are sufficiently "insulating". Moreover, the insulation does not have to be continuous over the entire thickness height of the conductive layer. The tubes, casing or tubing according to the name known in the art and standardized by the API (American Petroleum Institute) comprise at their two ends a male thread and a collar, screwed onto or integral with the body of the tube, having the corresponding female thread so as to be able to mutually assemble these tubes so as to form a casing. Preferably, the insulating layer will only be deposited on the body of the tube between the male thread (which obviously must not be covered) and the collar. Thus, the layer close to the threads would be destroyed by the jaws of the screwing means and can even be prejudicial for the suspension of the casing or the attachment of the jaws. The insulating layer can be a ceramic-filled epoxy covering, e.g. of the covering type used as anti-corrosion protection on maritime structures, pipelines and drill rods. It could also be a plasma-deposited ceramic layer, tar, preferably combined with polyurethane, plastic material strips, such as polyethylene, PVC, a mixture of resin and sand blasted onto the tube, a covering of impregnated glass fibres wound around the body of the tube. All coverings sufficiently insulating according to the requirements of the present application, i.e. leading to an electrical leakage resistance well above the characteristic resistance of the propagation line, can be suitable without passing outside the scope of the invention. In practice, said characteristic resistance is a few milliohms, so that it would be adequate to have a radial insulation resistance of approximately 1 ohm per casing segment in order to obtain a good efficiency of the device.

According to the invention, it is also possible to electrically insulate tubings by using an insulating material for cementing highly conductive areas, e.g. annular areas 3*a* and 3*b*. A circulation method is known in the art for putting into place a clinker cement with a given formulation opposite a given geological area. Thus, use will be made of said conventional method for placing the insulating material or improving the conductivity with respect to the low resistivity area.

FIG. 2 illustrates the case of the transmission system according to the invention during the drilling of a well 20 with the aid of a drill string 21 equipped at its end with a drilling tool 22. A transceiver E is generally located in the lower part in order to transmit drilling, trajectometry, gamma radiation, temperature, pressure and other parameters. The well 1 is in this case surface-cased by a casing 23 and an intermediate casing 24. Area 25 has a low resistivity excessively attenuating the transmission by EM between E and R. According to the invention, insulated tube elements will be located at 26 for casing 23 and at 27 for casing 24. In a variant, the annular space between casing 23 and the formation and the annular space between the casing 24 and the formation will be filled with insulating cement. Thus, the attenuation caused by the low resistivity of area 25 will be very substantially reduced, increasing by the same amount the capacity or speed of the transmission by E. In this system, the antenna is implemented by that part of the string between the insulating junction of the transmitter E and the drilling tool 22. In this case, the signal transmitted by the transmitter E will be attenuated from E up to an insulated or pseudo-insulated area 27 and then from area 26 to the surface receiver R. A mathematical propagation model taking into account the electrical characteristics of different casings and formations makes it possible to predetermine the minimum lengths of insulation areas 26 and 27 so as to be able to guarantee transmission.

It should be noted that that part of the tubes of casing 24 included in the casing 23 requires no insulation.

FIG. 3 shows a variant of the placing of the transmitter E in the drill string 21 and an example of the application of the invention in the case of offshore drillings with a subsea wellhead 29. Conventionally, in the case of operation or drilling with the subsea wellhead, the receiver R will be located at the bottom of the sea with one of its reception poles connected to the subsea wellhead and the other constituted by a piece of metal, e.g. an anchor 37, placed at a few dozen metres from the wellhead. Communication between the surface and the bottom of the sea takes place either by an acoustic transmitter, or by an electrical conductor installed along the casing. The soils 30 close to the seabed are generally geologically "young" and generally have a low resistivity. Therefore the surface casing 31 is advantageously insulated, according to the invention, over a height corresponding to the formation 30. The transmitter E is here located at the end of a predetermined cable length 32 for the purpose of creating a "long dipole". The cable is fixed by a support 33 within the interior of rods and is electrically connected to the transmitter located in a part remote from the rods 21. The wellhead 29 is connected to the floating drilling support by a marine riser 35. A kill-line or choke-line 36 passes substantially parallel along the riser from the wellhead to the floating support. It is advantageously possible to electrically insulate the line 36 for coupling the sea bed antenna 37 with the surface and thus obtain surface reception, i.e. on the floating support where line 36 ends.

It is clear that the long dipole arrangement described in FIG. 3 applies in all other drilling configurations and not only in the offshore case. In the case of operations where use is made of gasaerated mud, or even foam, EM transmission is the only possible transmission and has improved performance characteristics as a result of the improvement according to the invention.

FIG. 4 shows in section a tube element 40 usable for casing a hole or well drilled in an area with a too low resistivity. A steel tube body 41 is obtained by hot rolling. A male thread 42 and 43 is machined at the two ends. A collar 44 having female threads 45 is screwed onto one of the ends. The insulating covering (according to the definition given hereinbefore) is deposited on the central area 48. The areas 46 and 47 can be left unfinished, so that the jaws of the screwing robots have direct contact with the steel of the tube and this also applies with respect to the corners of the casing suspension table.

It is obvious that it is possible to entirely insulate the external surface of the casing, before or after screwing. However, this operation gives rise to numerous operational problems. Both practically and economically it is not desirable. This is why the present invention, which does not require a perfect insulation, is very advantageous.

Thus, the invention has all the advantages of transmission by electromagnetic waves and also permits an improvement to the performance characteristics, both in wells equipped for production or those being drilled. It also permits a more widespread use of EM transmission, particularly in the deep offshore sector.

The thus coated tubes are also more effectively cathodically protected, because the current to be injected for cathodic production will be reduced and will only pass to uncoated locations, which consequently require an electric protection potential against electro-corrosion. Thus, the coating can aid the adhesion of the cement to the tubes.

What is claimed is:

1. Method for the transmission of information from a well drilled through geological formation layers and at least partly cased by metal tubes, said method comprising the putting into place in said well of an information transceiver operating by means of guided electromagnetic waves created by the injection of an electrical signal by a dipole conductively connected to the metal tubes used for guiding the transmitted waves, characterized in that the attenuation of the transmission by certain formation layers having a low resistivity is identified and there is an at least partial electrical insulation of the metal tubes positioned opposite said low resistivity layers.

2. Method according to claim 1, wherein determination takes place with the aid of a mathematical model of the minimum length to be insulated, taking account of the minimum characteristics of said electromagnetic transmission, particularly the transmission distance and/or the information flow rate.

3. Method according to one of the claims 1 or 2, wherein insulation is obtained by putting into place tubes previously coated with an insulating material layer.

4. Method according to one of the claims 1 or 2, wherein insulation is obtained by the putting into place of an insulating material of the cement type opposite certain formations in the annular space between the tubes and the formations.

5. Method according to claim 1, wherein said transceiver is positioned close to the lower end of a production tubing in order to transmit seabed measurements or instructions to seabed equipment.

6. Method according to claim 1, wherein said transceiver is positioned close to the lower end of a drill string for transmitting seabed or drilling parameters or location measurements.

7. System for the transmission of information from a well drilled through geological formation layers and at least partly cased by metal tubes, said system comprising in said well an information transceiver operating by means of guided electromagnetic waves created by the injection of an electrical signal by a dipole conductively connected to the metal tubes used for guiding the transmitted waves, characterized in that at least some metal tubes positioned opposite low resistivity layers have electrical insulation means with respect to said formation.

8. System according to claim 7, wherein said insulated tubes are coated with an insulating material layer.

9. System according to claim 8, wherein the insulating layer does not entirely cover the complete length of the tube.

10. System according to claim 7, wherein said insulating means comprise an insulating material filling the annular space between said tubes and the conductive formation, said material being the result of the hardening of a liquid composition.

11. System according to one of the claims 7 to 10, wherein said transceiver is incorporated into the end of a production tubing.

12. System according to one of the claims 7 to 10, wherein said transceiver is incorporated into the end of a drill string.

13. Application of the system according to claim 7 to a sea drilling installation with a subsea wellhead.

14. Application according to claim 13, wherein a kill-line is externally electrically insulated from the seabed to the surface.

15. Method according to claim 1, wherein:

said metal tubes comprise two ends each having first threads, and a central area between said two ends, wherein a collar is screwed onto or integral with said tubes and has second threads mating with said first threads to mutually assemble ones of said tubes, said method comprising disposing said insulation only on said central area of tubes positioned opposite said layers having low resistivity.

16. System according to claim 7, comprising:

said metal tubes having two ends each having first threads, and a central area between said two ends; and a collar screwed onto or integral with said tubes and having second threads mating with said first threads to mutually assemble ones of said tubes;

said insulation is disposed only on said central area of tubes positioned opposite said layers having low resistivity.

* * * * *